United States Patent [19]

Hoffman et al.

[11] 4,380,359

[45] Apr. 19, 1983

[54] ELECTRICAL CONNECTOR FOR AN INSTRUMENT PANEL

[75] Inventors: Robert P. Hoffman, Grand Blanc; Lavern E. Chandler, Davison, both of Mich.

[73] Assignee: General Motors Corporation, Detroit, Mich.

[21] Appl. No.: 213,460

[22] Filed: Dec. 5, 1980

[51] Int. Cl.[3] ..... H01R 9/07; H01R 31/08

[52] U.S. Cl. ..... 339/17 F; 339/19; 339/221 R

[58] Field of Search ..... 339/14 R, 17 D, 17 F, 339/126 R, 127 R, 127 C, 188 T, 214 R, 214 S, 220 R, 220 L, 220 T, 221 R, 221 L, 19

[56] References Cited

U.S. PATENT DOCUMENTS

| | | | |
|---|---|---|---|
| 1,711,655 | 5/1929 | Reutter | 339/188 T |
| 2,844,644 | 7/1958 | Soule, Jr. | 174/35 |
| 3,314,042 | 4/1967 | Gabrielian | 339/17 D |
| 3,546,656 | 12/1970 | Pritulsky | 339/221 R |
| 3,617,611 | 11/1971 | Kuether et al. | 174/51 |

FOREIGN PATENT DOCUMENTS

| | | | |
|---|---|---|---|
| 2754619 | 6/1979 | Fed. Rep. of Germany | 339/17 F |

*Primary Examiner*—Neil Abrams

*Attorney, Agent, or Firm*—Warren D. Hill

[57] ABSTRACT

In order to make a ground connection between a printed circuit mounted on the back of an instrument panel housing and the metal frame of an instrument within the panel, a flexible spring clip is fixed to a pin projecting from the back of the housing and has a pair of legs straddling the pin each terminating in a contact which conductively engage the printed circuit and the instrument frame respectively. An aperture in the housing allows one leg of the spring clip to extend into the housing adjacent the instrument.

3 Claims, 4 Drawing Figures

ELECTRICAL CONNECTOR FOR AN INSTRUMENT PANEL

This invention relates to a flexible electrical connector for an instrument panel and more particularly to such a connector for coupling a printed circuit conductor to an instrument conductor.

The instrument cluster of an automotive vehicle is frequently composed of a group of instruments including a speedometer having a rear housing comprising a molded polymer member which supports the instruments and a clear front panel for display viewing. The rear housing portion carries a flexible printed circuit on its outer surface and electrical connections are made through the housing to the various instruments. The speedometer frame in particular is connected to a ground conductor on the printed circuit. Traditionally that connection has been carried out by a threaded fastener secured to the rear housing in contact with the printed circuit and engaging the metal speedometer frame to complete the ground circuit. That structure requires the installation of a screw upon assembly and requires that the ground screw be removed from the back of the panel in order to remove the speedometer for purposes of repair or replacement.

It is therefore a general object of this invention to provide a connector for electrically coupling an instrument in an instrument panel to a printed circuit on the rear of the instrument housing. It is a further object to provide such an electrical connector which requires no threaded parts.

The invention is carried out by providing a pin on the rear of a molded polymer instrument housing, an aperture in the housing adjacent the pin, and a spring clip secured to the pin with legs straddling the pin, one leg extending through the aperture into a spring engagement with the frame of an instrument and the other leg extending into contact with a printed circuit conductor adjacent the pin.

The above and other advantages will be made more apparent from the following specification taken in conjunction with the accompanying drawings wherein like reference numerals refer to like parts and wherein.

Figure 1:
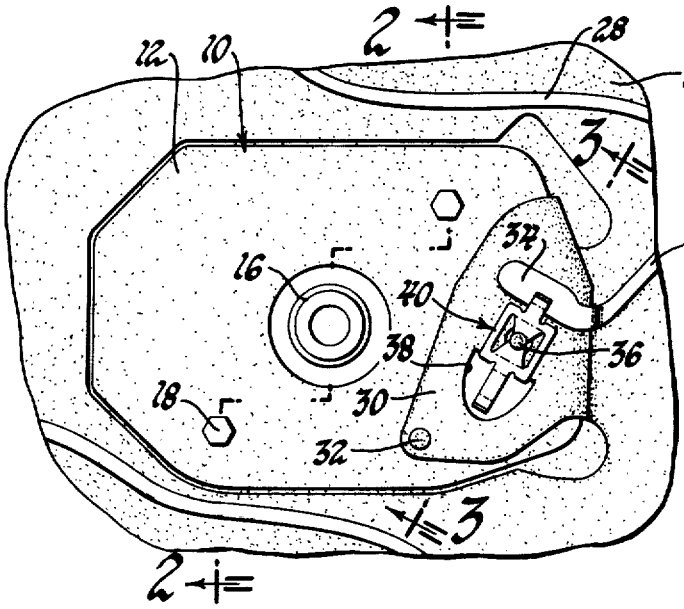
FIG. 1 is an elevational view of a portion of the rear of an instrument panel including a resilient clip according to the invention.
Figure 2:
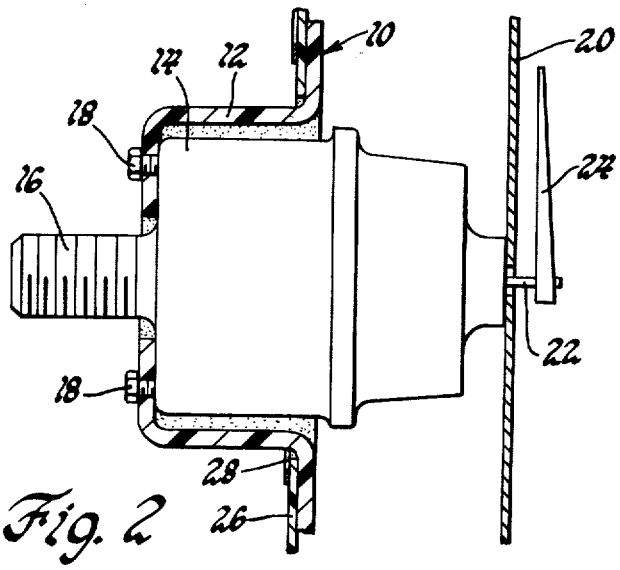
FIG. 2 is a cross-sectional view taken along lines 2—2 of FIG. 1 showing a speedometer mounting in the instrument panel.
Figure 3:
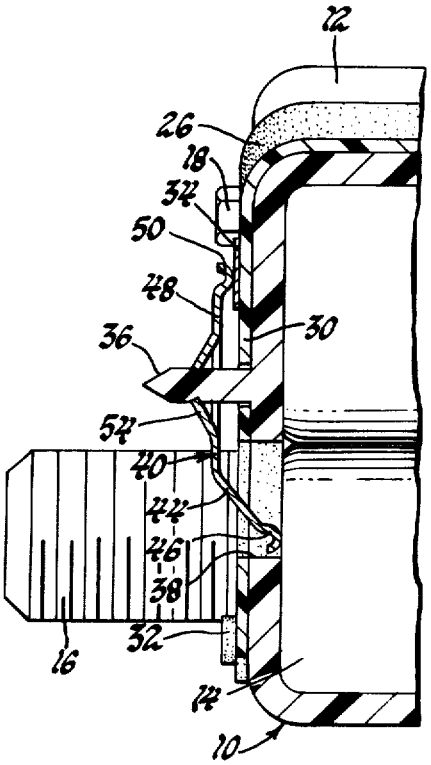
FIG. 3 is a cross-sectional view taken along lines 3—3 of FIG. 1 showing the installation of the resilient clip according to the invention.

Referring to FIGS. 1 and 2 the molded polymer rear housing 10 of an automotive instrument panel includes a well 12 which receives a speedometer 14. A rearwardly extending hub 16 of the speedometer projects through an aperture in the housing 10. Threaded fasteners 18 extend through the housing and screw into the rear of the frame of the speedometer 14 to securely hold the speedometer to the housing. The front of the speedometer 14 supports a dial 20 carrying speed indicia and has a rotatable shaft 22 extending through the dial and carrying a pointer 24. A flexible printed circuit 26 is secured to the rear of the housing 10 and includes conductors 28. One portion of the printed circuit comprises a flap 30 which extends up the side of the well 12 and partially across the rear thereof and is secured to a peg 32 projecting from the rear of the housing. Otherwise, the printed circuit 26 has a cut out area corresponding to the configuration of the well 12 to lie flat on the housing surface surrounding the well. One of the conductors 28 extends onto the flap 30 and terminates in a pad 34 adjacent to a pin 36 which projects rearwardly from the molded housing and is formed integrally therewith. An opening 38 is formed in the housing adjacent the pin 36 on the opposite side thereof from the conductive pad 34. A similar opening is formed in the printed circuit so that, as best shown in FIG. 3, a conductive spring clip 40 secured to the pin 36 can extend through the housing to engage the frame of the speedometer 14.

Figure 4:
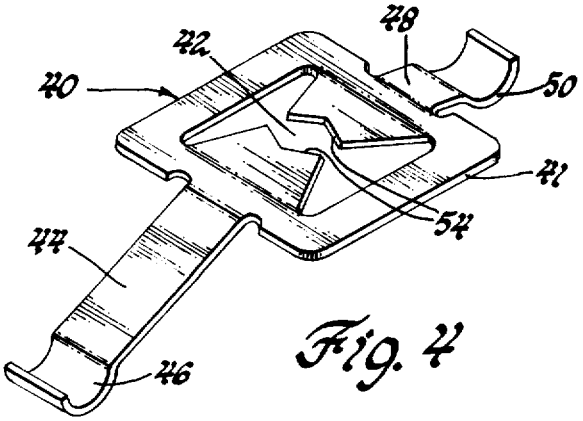
FIG. 4 is an isometric view of the resilient clip of FIGS. 1 and 3.

The spring clip 40 is stamped from thin beryllium copper sheet stock. As shown in FIGS. 3 and 4, the clip 40 includes a generally square body 41 having an aperture 42 for grippingly sliding over the pin 36, a long arm 44 for extending from one side of the body through the opening 38 and terminating in a contact 46 engaging the frame of the speedometer 14 and a short arm 48 extending from the body opposite the arm 44 and terminating in a contact 50 which engages the conductive pad 34 on the printed circuit flap 30. Gripping teeth 54 extend into the aperture 42 from opposite sides of the body 41 for biting into opposite sides of the pin 36. The legs 44 and 48 are bent forwardly from the plane of the body portion 41 and the gripping teeth 54 are bent slightly backward from the plane of the body 41. The spring clip is applied to the housing by pushing the toothed aperture 42 over the pin 36, the angle of the teeth 54 facilitating that sliding movement and causing the teeth 54 to bite into the polymer pin 36 to resist removal of the spring clip. The legs of the spring clip straddle the pin 36 and are pressed in a flexed-down position against the printed circuit and the speedometer frame respectively. The deflection of the arm 44 caused by installation of the speedometer provides a moment about the pin 36 and the reaction to this moment is provided by the arm 48 to enhance the electrical contact with the conductive pad 34.

An alternate structure for mounting a speedometer in the housing is to provide posts extending from the housing to the dial 20 and fastening the dial to the posts by screws to thereby support the speedometer 14. With that structure, the speedometer can be installed or removed from the housing from the front since no screw connections are necessary at the rear of the speedometer frame to provide a grounding path.

While the conductive clip is specifically intended to provide a ground connection from a speedometer to a grounded printed circuit conductor, it will be apparent that the same structure can be used for other electrical connections to instruments in an automotive instrument panel.

The embodiments of the invention in which an exclusive property or privilege is claimed are defined as follows:

1. In a vehicle instrument panel, means for electrically connecting an instrument to a circuit comprising an instrument panel housing formed of insulating material having an integral substantially rigid pin projecting from a surface of the housing, the circuit including a printed circuit carried by the housing on said surface, an exposed conductor in the printed circuit adjacent and spaced from the pin, an instrument positioned adjacent the housing and having a conductive portion facing the printed circuit, and an elongated resilient conducting clip having free ends and a contact portion at each end, the contact portions electrically seating in flexed-down spring engagement against the said conductive portion of the instrument and the exposed conductor on the printed circuit, respectively, for electrically connecting the printed circuit and the instrument, the clip further having means intermediate the contact portions for gripping the pin to hold the clip in bridging position.

2. In a vehicle instrument panel, means for electrically connecting an instrument to a circuit comprising an instrument panel housing formed of insulating material having an integral substantially rigid pin projecting from a surface of the housing, the circuit including a printed circuit carried by the housing on said surface, an exposed conductor in the printed circuit adjacent and spaced from the pin, an instrument positioned adjacent the housing and having a conductive portion facing the printed circuit, and an elongated resilient conducting clip having free ends, a contact portion at each end and pin gripping means intermediate the ends for gripping the pin whereby the clip is held in flexed-down position so that the contact portions electrically seat with spring engagement to exert force against the said conductive portion of the instrument and the exposed conductor on the printed circuit, respectively, for electrically connecting the printed circuit and the instrument.

3. In a vehicle instrument panel, means for electrically connecting an instrument to a circuit comprising an instrument panel housing formed of insulating material, a substantially rigid pin projecting from a surface of the housing and an opening in the housing adjacent one side of the pin, the circuit including a printed circuit carried by the housing on said surface, an exposed conductor in the printed circuit adjacent a side of the pin opposite the said opening, an instrument positioned adjacent the housing and having a conductive portion at the side facing the printed circuit, and an elongated resilient conducting clip having an apertured body portion with inwardly extending gripping teeth engaging the pin and holding the clip in flexed-down position and a pair of legs extending oppositely from the body portion and a contact portion at the end of each leg, one leg extending through the opening with its contact portion electrically seating with spring engagement against the said conductive portion of the instrument and the contact portion on the other leg seating with spring engagement against the exposed conductor on the printed circuit for electrically connecting the printed circuit and the instrument.

* * * * *